US005373966A

United States Patent [19]

O'Reilly et al.

[11] Patent Number: 5,373,966

[45] Date of Patent: Dec. 20, 1994

[54] SINGLE USE DISPENSING SACHETS AND METHOD OF AND MEANS FOR MANUFACTURE OF SAME

[76] Inventors: Daniel J. O'Reilly, 'Tara' Coney Weston Rd., Sapiston, Suffolk, Great Britain, 1P31 1RX; John Maloney, 9 Oakridge, Wethenby, Great Britain, LS22 4GT

[21] Appl. No.: 961,726

[22] PCT Filed: May 31, 1991

[86] PCT No.: PCT/GB91/00875

§ 371 Date: Jan. 12, 1993

§ 102(e) Date: Jan. 12, 1993

[87] PCT Pub. No.: WO91/18804

PCT Pub. Date: Dec. 12, 1991

[30] Foreign Application Priority Data

Jun. 1, 1990 [GB] United Kingdom ..... 9012291
Aug. 11, 1990 [GB] United Kingdom ..... 9017649

[51] Int. Cl.[5] ..... B65D 75/38; B65D 30/22; B65B 9/02; B31B 41/00

[52] U.S. Cl. ..... 222/94; 222/107; 222/564; 383/38; 383/210; 206/484; 53/410; 53/451

[58] Field of Search ..... 222/94, 107, 564; 206/484, 219; 383/38, 44, 109, 210, 211; 53/410, 451

[56] References Cited

U.S. PATENT DOCUMENTS

| | | | |
|---|---|---|---|
| 2,681,168 | 6/1954 | McMillion | 222/94 |
| 3,334,790 | 8/1967 | Eaton | 222/107 |
| 3,390,507 | 7/1968 | Repko | 383/38 X |
| 3,453,661 | 7/1969 | Repko | 401/132 |
| 4,201,031 | 5/1980 | Wiles | 383/38 X |
| 4,312,473 | 1/1982 | Hoeller | 229/56 |
| 4,331,264 | 5/1982 | Staar | 222/94 |
| 4,557,377 | 12/1985 | Maloney | 206/219 |
| 4,793,121 | 12/1988 | Jamison | 53/410 |
| 4,856,651 | 8/1989 | Francis, Jr. | 206/219 |
| 4,872,556 | 10/1989 | Farmer | 222/107 X |
| 4,890,744 | 1/1990 | Lane, Jr. et al. | 383/210 |
| 5,131,760 | 7/1992 | Farmer | 222/107 X |

FOREIGN PATENT DOCUMENTS

| | | | |
|---|---|---|---|
| 272160 | 6/1198 | European Pat. Off. . | |
| 1152552 | 5/1969 | United Kingdom . | |
| 2180214 | 3/1987 | United Kingdom | 222/107 |
| 9008705 | 8/1990 | WIPO | 222/107 |

*Primary Examiner*—Andres Kashnikow
*Assistant Examiner*—Anthoula Pomrening

[57] ABSTRACT

A single use dispensing sachet (10) which is made up of flexible sheet sections (14,16) peripherally sealed (12) to define an outer envelope, and within the outer envelope is a sealed compartment containing the sachet contents. The compartment is ruptured to displace the contents into an expansion chamber within the sachet so as to retard the flow of the contents and prevent splashing. The sachet may have a baffle (32) defined by a line of sealing connecting the outer sheet sections of the sachet, the baffle forming an obstruction between the contents emerging from the ruptured sealed compartment to an outlet at the periphery of the sachet. Also described is a method and machine for manufacturing the sachets.

5 Claims, 13 Drawing Sheets

SINGLE USE DISPENSING SACHETS AND METHOD OF AND MEANS FOR MANUFACTURE OF SAME

This invention relates to single use dispensing sachets, and also relates to a method of manufacturing the sachets.

Single use dispensing sachets are well known and are in extensive use. Typically, the known sachets comprise envelopes of plastics material made up of two sheets sealed together at the edges. Between the sheets is contained the sachet contents, usually being of a liquid or fluent pasty medium. Typically the contents may comprise shampoo, medication, soap, food pastes, sauces, creams and so on. In the sachets according to the present invention, the contents will be of a liquid or fluent nature which can be poured from the sachet including sauces, condiments, hair care products, cosmetics, DIY products, car care and health care products, but the actual contents material is not in essence to the present invention.

Also, although the sachets according to the present invention may principally be constructed of flexible plastics material, it is to be mentioned that other flexible sheet materials can be used such as metallic foils, laminates and the like.

To gain access to the contents in the known sachets, it is necessary to break the sachets open. This may be done by tearing or by cutting or by pressure rupturing, but whatever the method used, as soon as release of the contents takes place, the sachet must be arranged so that the contents are discharged in a particular direction or in a particular location as by virtue of the nature of the sachets, the contents will be discharged directly into the surrounding atmosphere. Obviously, if these sachets rupture undesirably when in the wrong location or position, considerable mess and inconvenience can result.

The present invention aims at providing a novel form of single use sachet which at least in its preferred embodiment does not suffer from the disadvantages of the conventional sachet mentioned above.

In accordance with the present invention a sachet for dispensing a portion of a fluent medium characterized in that the sachet is entirely of flexible sheet material sections sealed together to define a sealed compartment containing said fluent medium, and an expansion chamber, said sealed compartment being designed to be popped open by hand pressure to cause the fluent medium to be ejected from the compartment into the expansion chamber which slows down the ejecting medium and retains it in the sachet, said expansion chamber either having an outlet or being adapted to be provided with an outlet at a predetermined location, whereby the medium can at the user's leisure be poured directly from the sachet.

In one embodiment, the outlet comprises a series of apertures in a sheet section forming an outer side wall of the sachet, which side wall lies against a sheet section which is interior of the sachet and defines the sealed compartment.

Preferably, the sheet sections defining the expansion chamber are sealed together to form a baffle to the ejecting medium to change its direction of flow in the expansion cheer.

Alternatively, the sachet is made up of three sheet sections of the same size and sealed peripherally in face to face arrangement, the sealed compartment being defined between one of the outer sections and the middle section.

Preferably also, the sachet is made up of two sheet sections of the same size sealed peripherally in face to face arrangement, the sealed compartment and expansion chamber being defined by an additional weak seal line which connects the two sheet sections along a line extending between two points on the periphery of the sachet.

According to another feature, an outlet is provided in the expansion chamber by providing a gap in the peripheral seal of the sachet.

Preferably, said baffle is located between the sealed compartment and the outlet.

In using a sachet according to the invention pressure is applied to the sachet to cause the sealed compartment to pop or rupture and to discharge the contents into the expansion chamber which slows down the contents preventing them from being ejected undesirably and prematurely from the outlet, and then the contents are caused by manipulation of the sachet to flow towards and be poured directly out of the outlet. The pressurizing of the sealed compartment may be effected by progressively rolling the sachet up until the sealed compartment ruptures.

When the baffle is provided, and when the sealed compartment is ruptured, the contents discharge towards the baffle and then flow round same and eventually to the outlet.

The sealed compartment may be in the form of sheet material folded in two and sealed at the edges.

The embodiments of the invention made up of three or two panels as described above lend themselves to methods of manufacturing the sachets on a continuous basis. Therefore, according to another aspect of the invention there is provided a method of manufacturing sachets as aforesaid comprising feeding in the same direction three webs of flexible sheet material in face to face arrangement, sealing the outer webs and the inner web together in the direction of feeding of the webs and transverse to said feeding direction partially to define the sealed compartments and the expansion chambers, inserting the fluent medium in said partially defined compartments, sealing the webs transverse to the feeding direction to complete the sealing of the expansion chambers and compartments and also including the step of creating a break in the peripheral seals of the outer webs to form said outlet.

Further according to the invention there is provided a method of manufacturing sachets as aforesaid comprising feeding in the same direction two webs of flexible sheet material in face to face arrangement, sealing the webs together in the direction of feeding and transverse to said direction partially to define the sealed compartments, inserting the fluent medium in said partially defined compartments, sealing the webs transverse to said direction of feeding to define said weak seals, and to complete the sealing of the expansion chambers, and also including the step of weakening a break in the peripheral seals of the outer envelopes to form said outlets.

Embodiments of the invention will now be described, by way of example, with reference to the accompanying diagrammatic drawings, wherein.

Figure 1:
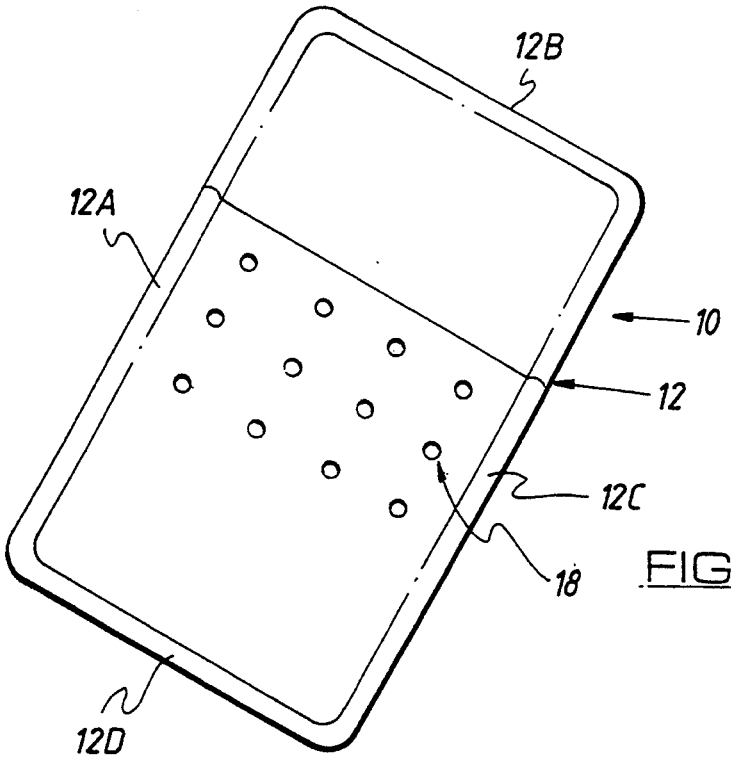
FIG. 1 is a perspective view of a sachet according to a first embodiment of the invention.
Figure 20:
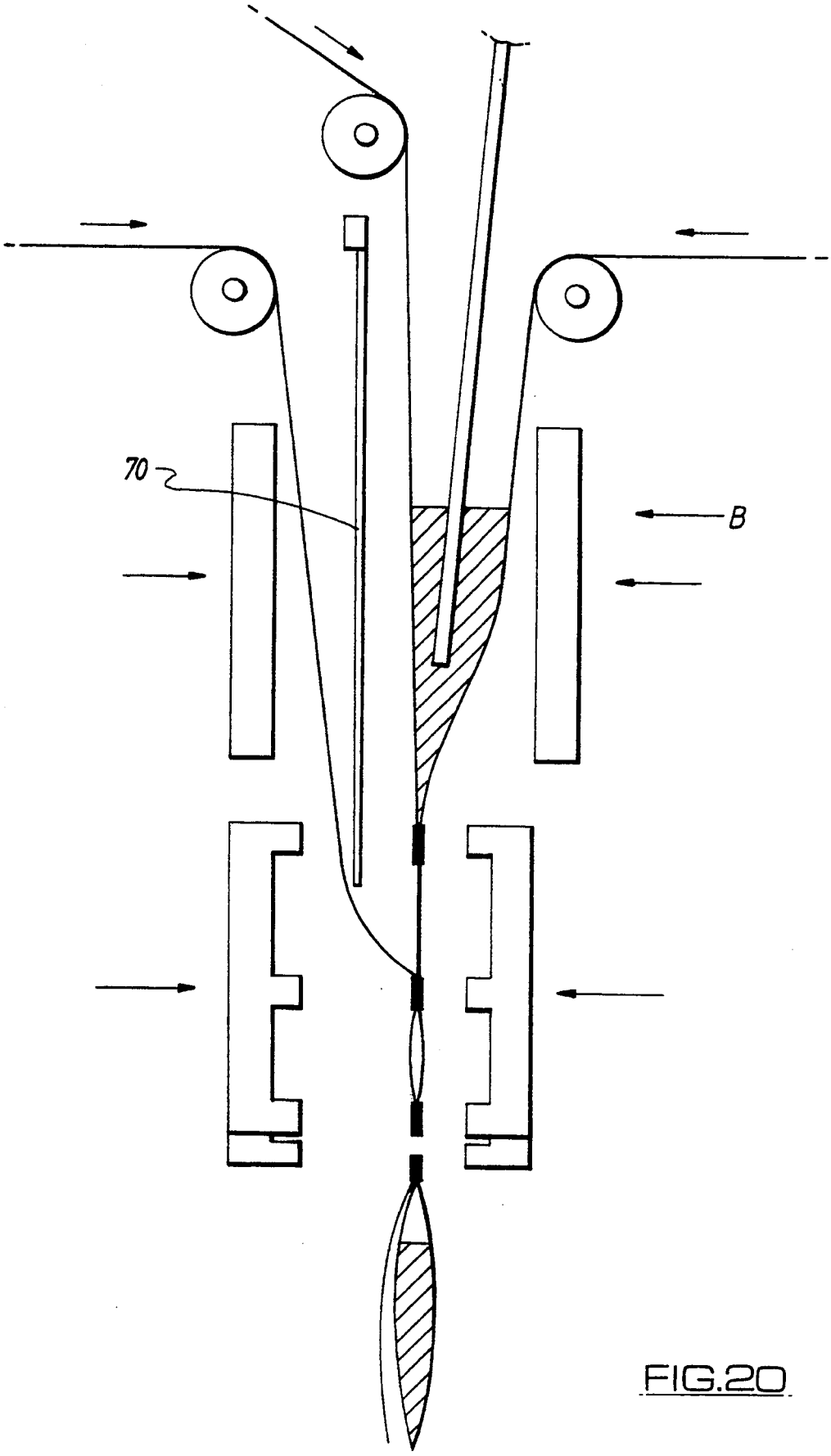
FIG. 20 is a view similar to FIG. 19 but showing a modification of the method.
Figure 21:
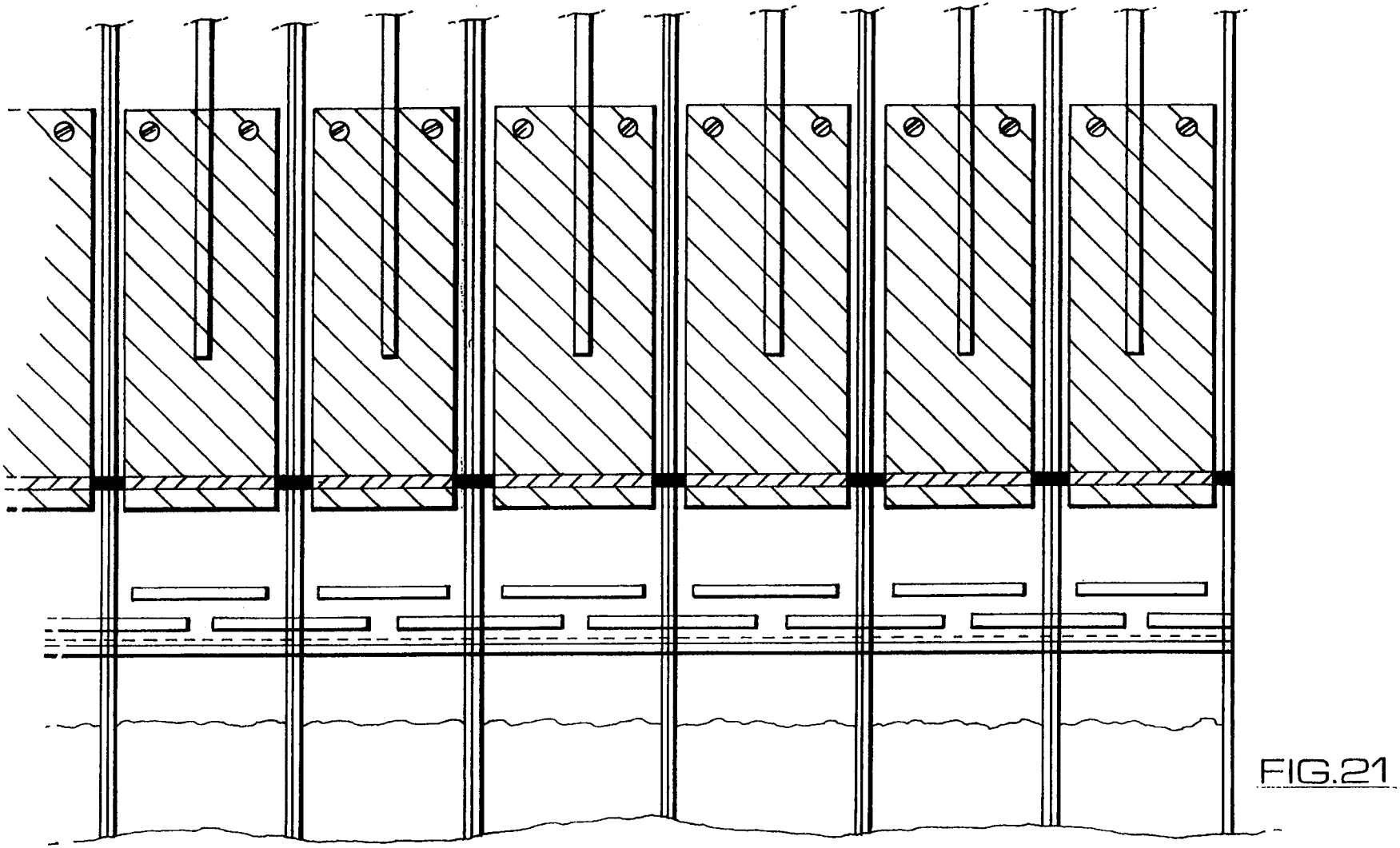
Figure 22A:
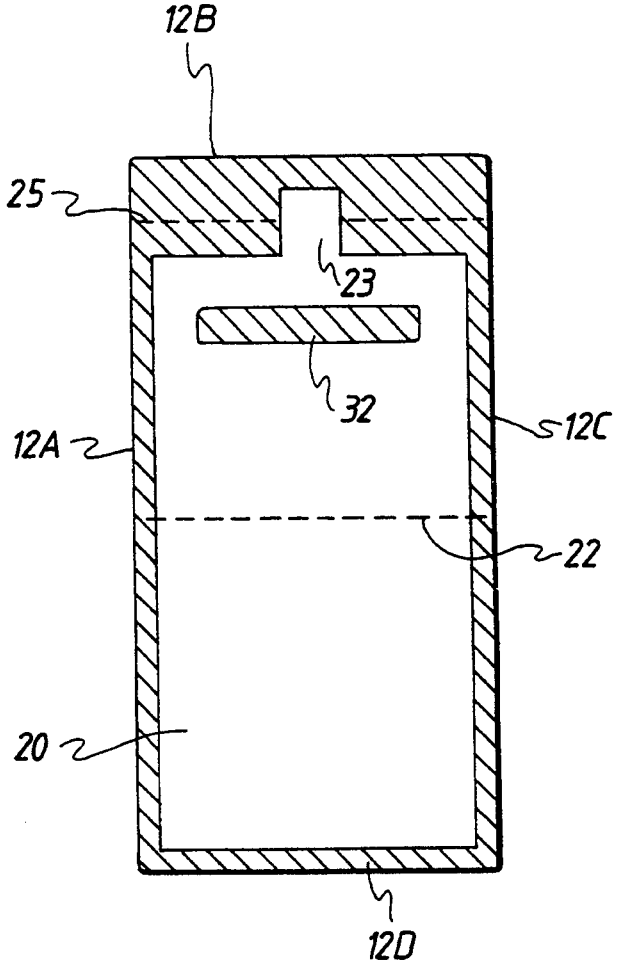
Figure 22B:
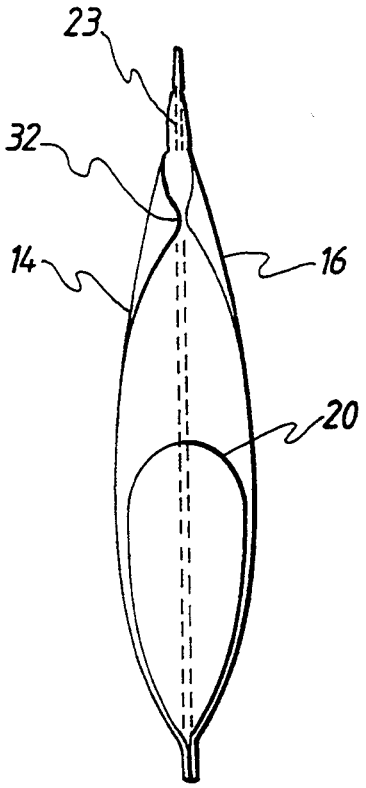

FIG. 21 is a view of the apparatus of FIG. 20 looking in the direction of arrow B in FIG. 20; and FIGS. 22A and 22B show in front view and sectional elevation a sachet according to a further embodiment of the invention Referring to the drawings, in FIG. 1 a sachet 10 is made up of flexible plastics sheet material, which preferably is clear so that the contents of the sachet can be identified, but it is to be mentioned that this is not a requisite of the present invention as the sachet could be opaque and could be printed with appropriate instructions and coloring.

As shown in FIG. 1 the sachet 10 is generally rectangular, and has an edge seal 12.

Figure 6:
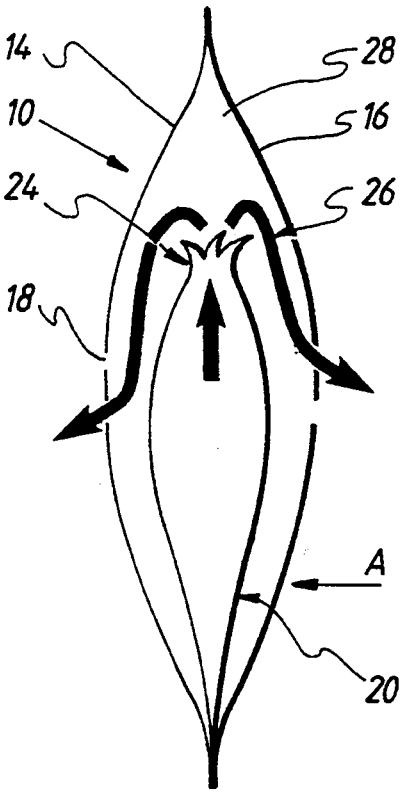
FIG. 6 is a sectional side view showing how the contents of the sachet are dispensed.

As best shown in FIG. 6, the sachet 10 comprises a pair of outer panels 14, 16 which are sealed together around the edge 12 to define edge seal regions 12A, 12B, 12C and 12D. At least one of the panels, say panel 14 is provided with apertures 18 therein and approximately centrally thereof for the dispensing of the sachet contents.

The sachet is provided with an inner sealed compartment 20 which is made up of sheet material folded in two. The compartment 20 is shorter in height, in FIG. 6, than the outer envelope 14, 16 and its edges are sealed together, and also sealed to the outer panels 14, 16 around the edge 12 as will be understood from FIG. 6, which actually shows the inner sealed compartment in the stage of rupturing.

Figure 4:
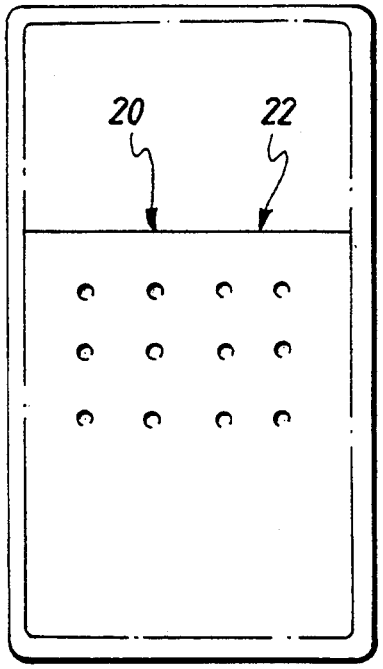
FIG. 4 is a side view of the sachet shown in FIG. 1.
Figure 5:
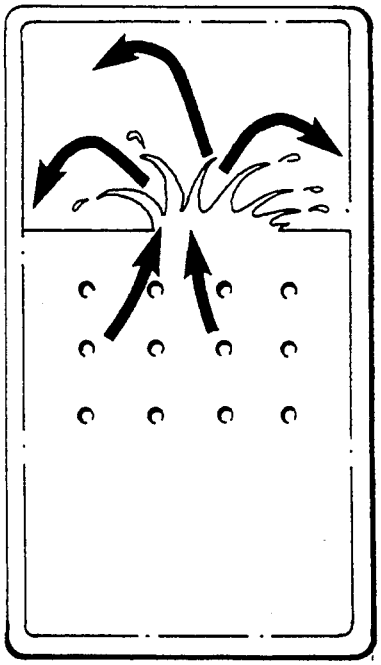
FIG. 5 is a diagram illustrating the rupturing of the inner compartment of the sachet of FIG. 1.

The sealed compartment in its state before rupturing is shown in FIG. 4.

Figure 2:
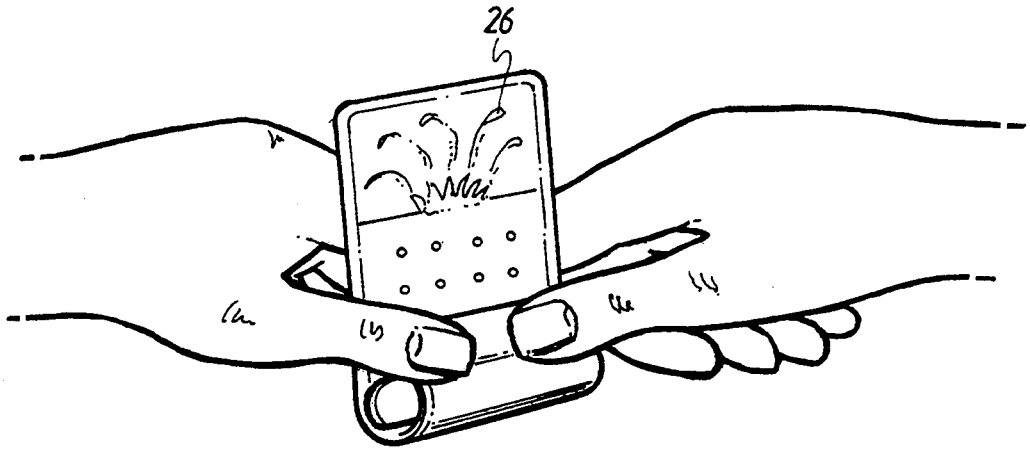
FIG. 2 shows how the sachet of FIG. 1 is used.
Figure 3:
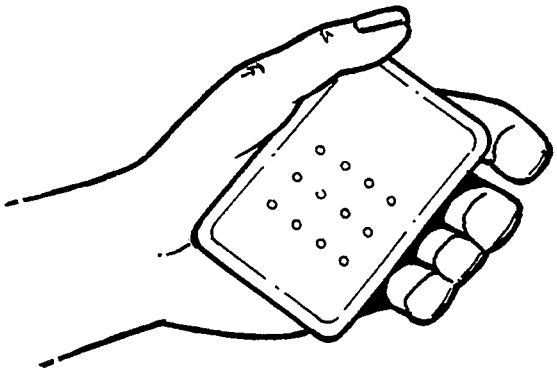
FIG. 3 shows how the sachet of FIG. 1 may be held in the hand for application of the contents.

In order to use the sachet it is simply a matter of rupturing the sealed compartment for example by rolling the sachet up as shown in FIG. 2 until the pressure of the contents inside the sealed compartment 20 forces same to rupture along the top folded edge 22, as indicated at 24 in FIG. 6. The contents flow out as indicated by reference 26, and discharged into the space 28 between the outer envelope and the inner sealed compartment which in fact forms an expansion chamber and enables the issuing contents to decrease in velocity. There is no splashing of the contents outwardly of the sachet and in an undesirable manner. At the time of rupturing, it will be noticed that the panels 14 and 16 are stretched against the sealed compartment 20 and therefore the apertures 18 will in fact be temporarily sealed. When the compartment 22 ruptures, the user can then manipulate the sachet and force the contents to the apertures 18 so that the contents are dispensed as shown for example in FIG. 6. An extremely convenient and useful sachet product therefore results and a restraint is placed upon the dispensing of the sachet contents by the utilization of the expansion chamber. By placing the apertures 18 in relation to the sealed compartment 20 so that they are sealed during the rupturing of the sealed compartment another advantage results.

Figure 7:
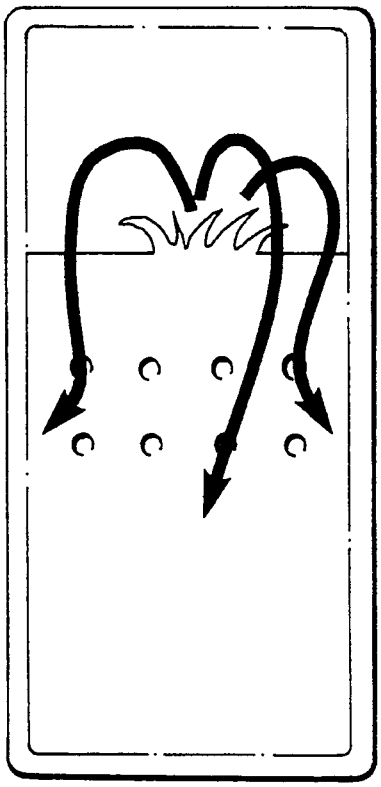
FIG. 7 is a view of the sachet of FIG. 6 looking in the direction of arrow A.
Figure 7A:
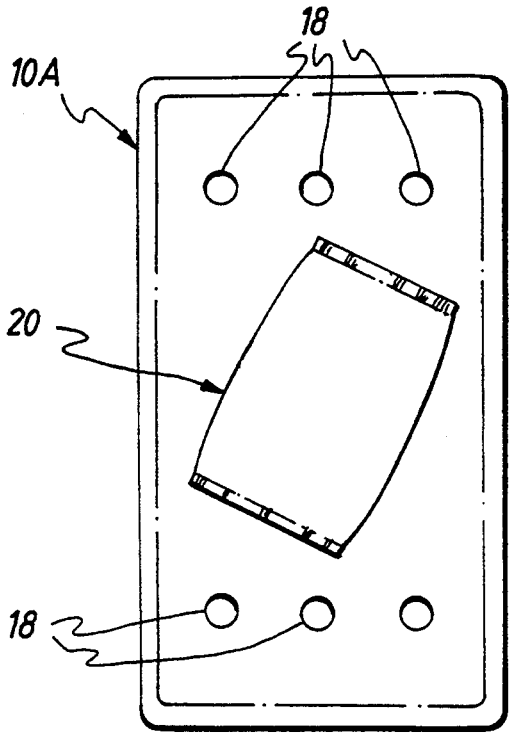
FIGS. 7A and 7B show in front view and sectional elevation a modified form of the invention.
Figure 7B:
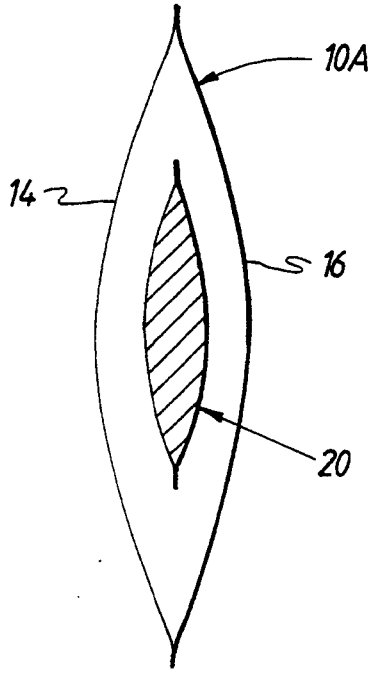

In the embodiment of the invention shown in FIGS. 7A and 7B the inner compartment 20 is defined by a sealed, separate sachet 20 containing the liquid or other material to be dispensed, and it is contained within an outer envelope 10A, which has the apertures 18. The sachet 20 and outer envelope are of plastics material and dispensing is achieved by rupturing the inner sachet 20 by the application of hand pressure. The liquid is eventually dispersed through the holes 18.

Figure 7C:
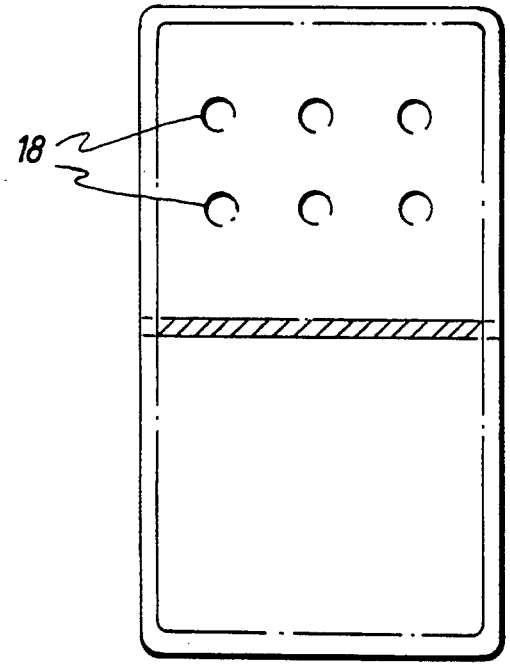
FIGS. 7C and 7D are views similar to FIGS. 7A and 7B but show a further embodiment.
Figure 7D:
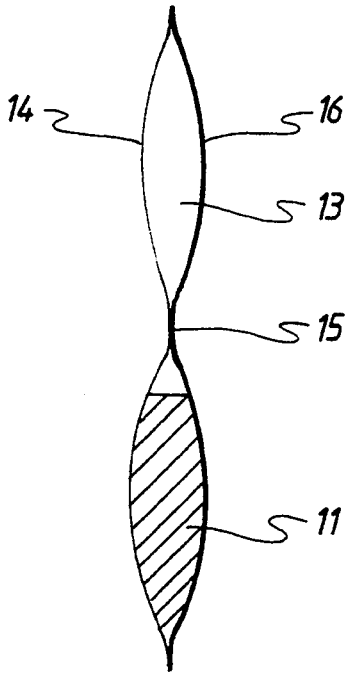

The sachet of FIGS. 7C and 7D is a single envelope formed by the sheet 14, 16 sealed round the edges and also sealed transversely by a weak seal 15 splitting the interior into two compartments 11, 13, the compartment 11 containing the liquid to be dispensed. The holes 18 are in the section of the envelope defining the compartment 13. To dispense the material, the seal is caused to yield by pressing compartment 11, when the material flows into the compartment 13, which forms an expansion chamber, and eventually out of the holes 18.

Figure 8:
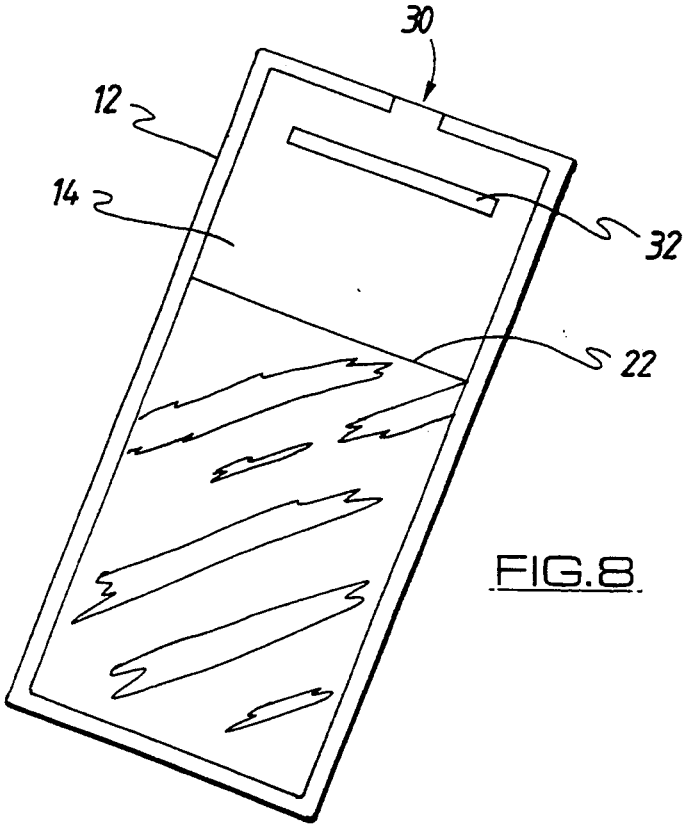
FIG. 8 is a perspective view of a sachet according to another embodiment of the invention.

In the embodiment of the invention shown in FIG. 8, the sachet is essentially constructed in the same manner as the earlier embodiments except that instead of the apertures 18 being in the panels 14 and/or 16, a single outlet aperture 30 is provided at the end of the sachet and in the seal 12 as to oppose the folded edge 22 of the sealed compartment.

Figure 9:
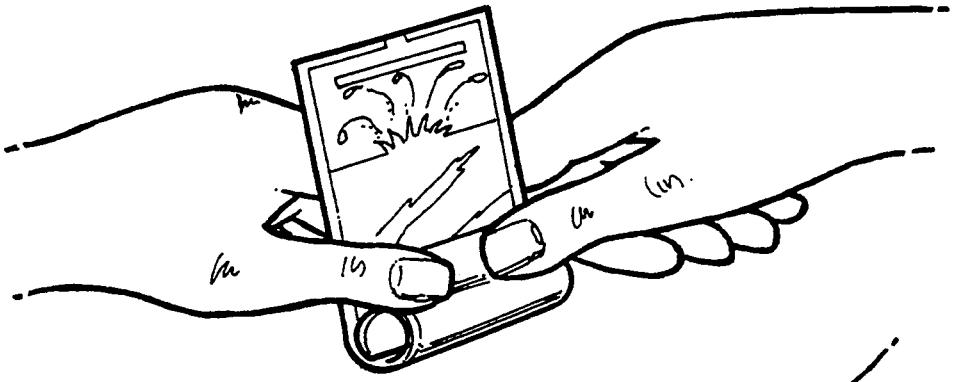
FIG. 9 is a view showing how the sealed compartment of the sachet of FIG. 8 is ruptured.
Figure 10:
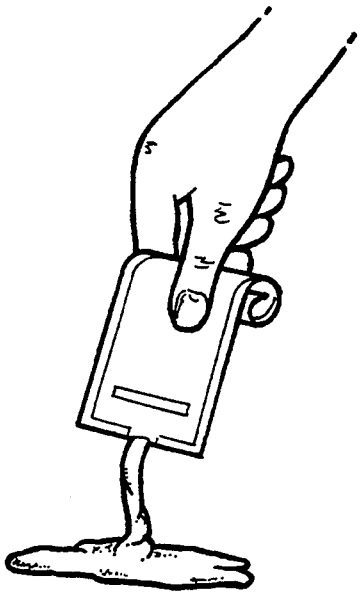
FIG. 10 is a view showing how the contents can be dispensed.
Figure 12:
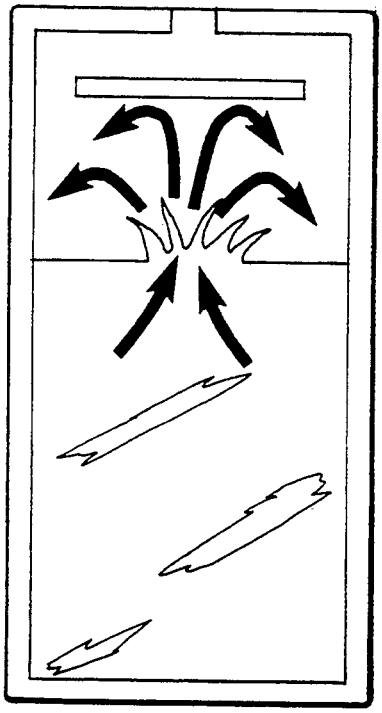
FIG. 12 is a side view showing the rupturing of the sealed compartment of the sachet shown in FIG. 8.
Figure 13:
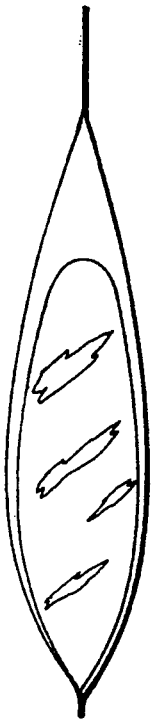
FIG. 13 is a sectional end view of the sachet shown in FIG. 11.
Figure 14:
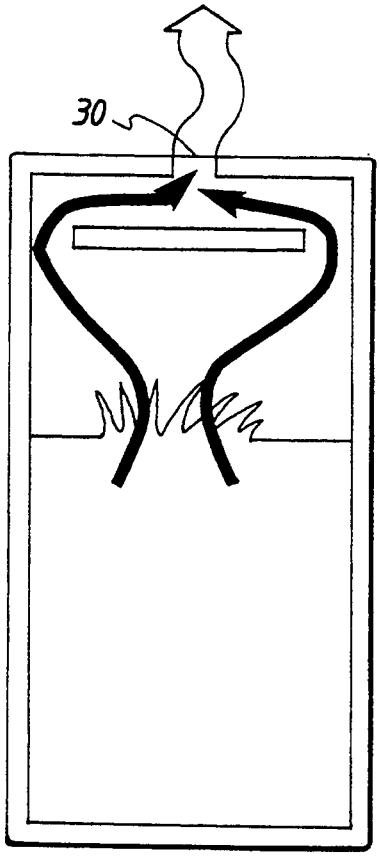
FIG. 14 is a side view of the sachet shown in FIG. 11 illustrating the dispensing of the contents.

Additionally, the outer panels 14 and 16 are sealed along a baffle line 32 between the said aperture 30 and the said edge 22 to prevent the contents when the inner compartment is ruptured from issuing directly through the aperture 30. The baffle acts as shown in FIGS. 12 and 14 to divert the contents when rupturing takes place, but eventually as shown in FIG. 14, the contents can be caused to pass the ends of the sealed bar region 32 and issue from the aperture 30. As shown in FIGS. 9 and 10 the sachet can be rolled up for rupturing of the sealed compartment and also for the dispensing of the contents through the aperture 30.

Figure 11:
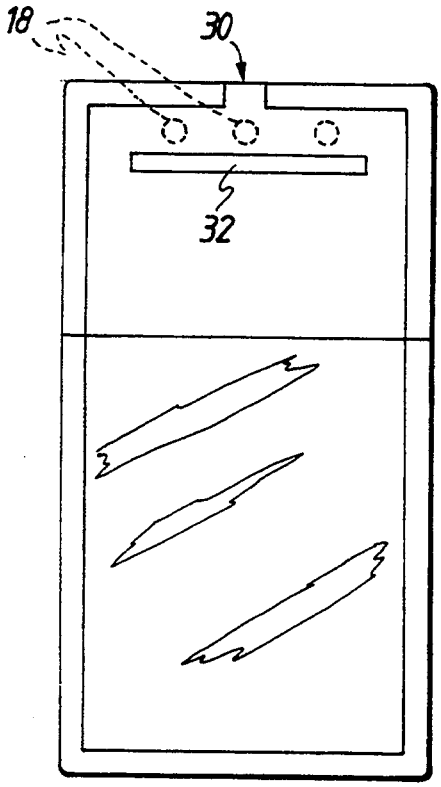
FIG. 11 is a side view of the sachet shown in FIG. 8.

FIG. 11 shows in dotted lines that the dispensing holes 18 may be provided in the outer envelope between the seal 32 and the adjacent end of the sachet in which case the aperture 30 would be omitted.

FIGS. 13A to 13H show various embodiments which are similar to the embodiments shown in FIGS. 8 to 14 18 that they embody a peripheral dispensing aperture 30 and in some cases also embody the baffle seal 32, or alternatives thereof. Essentially, the embodiments of FIGS. 13A to 13H are used in the same manner as the embodiments already described and are constructed from the same flexible plastics sheet material.

Figure 13A:
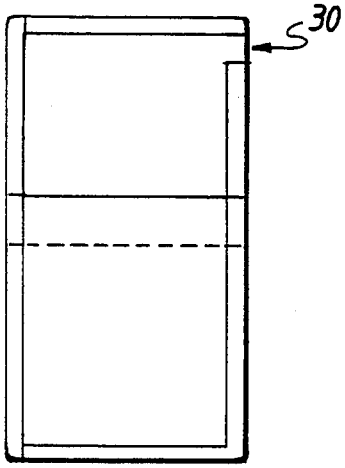
FIGS. 13A and 13B show in front view and sectional elevation a modified form of the invention.
Figure 13B:
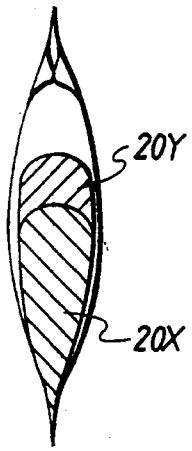

In FIGS. 13A, 13B embodiment, the opening 30 is at the side of the sachet as opposed to being at the end, and the seal 32 is omitted.

Figure 13C:
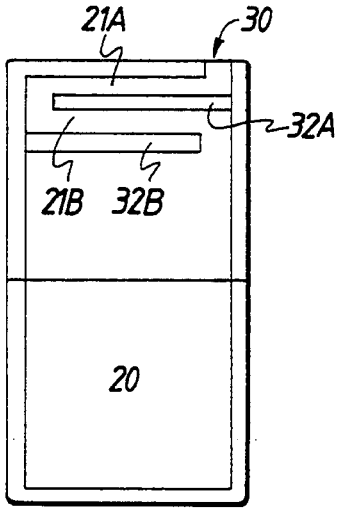
FIGS. 13C and 13D show in front view two further modified forms of the present invention.

In FIG. 13C, the central seal 32 is replaced by two overlapping seals 32A, 32B which extend from the respective sides but stop short of the other sides of the sachet so that the material to be dispensed, when the compartment 20 is ruptured, must flow along a sinuous path 21A, 21B to reach outlet 30. Outlet 30 is at the corner of the sachet, but is in the end of the same.

Figure 13D:
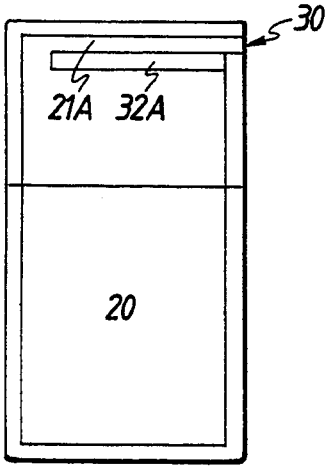

In FIG. 13D only the seal 32A is provided so that the material when the compartment 20 is ruptured has to pass along path 21A to outlet 30.

In each case (FIGS. 13C and 13D) the seals 32A, 32B form baffles to prevent the undesired splashing of the material out of the outlet 30 when the compartment 20 is ruptured.

Figure 13E:
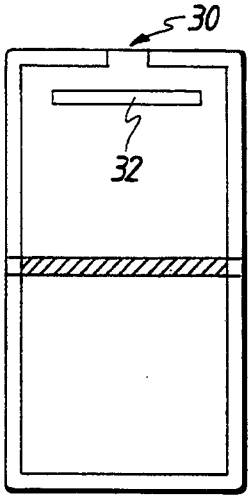
FIGS. 13E and 13F show similar to FIGS. 13A and 13B a further modified form of the invention.
Figure 13F:
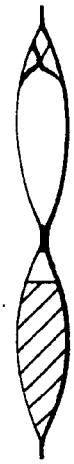
Figure 13G:
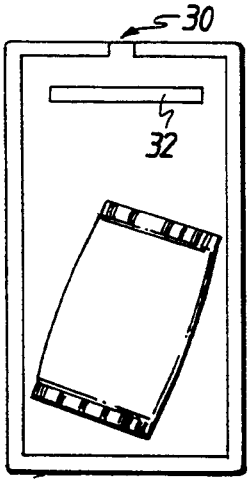
FIGS. 13G and 13H show similar to FIGS. 13A and 13B a still further modified form of the invention.
Figure 13H:
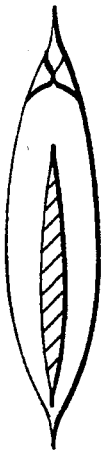

The embodiment of FIG. 13E and 13F is similar to the FIG. 7C and 7D embodiment, except that the holes 18 are replaced by the baffle 32 and outlet 30.

FIG. 13B shows that the inner compartment may in fact be formed by two webs folded in two, to define two compartments 20X and 20Y which contain respective ingredients to be mixed, and which are ruptured in turn to achieve this mixing, before dispensing from the aperture 30 takes place. This feature may be embodied, where possible, in any of the embodiments of the invention described herein.

Figure 15:
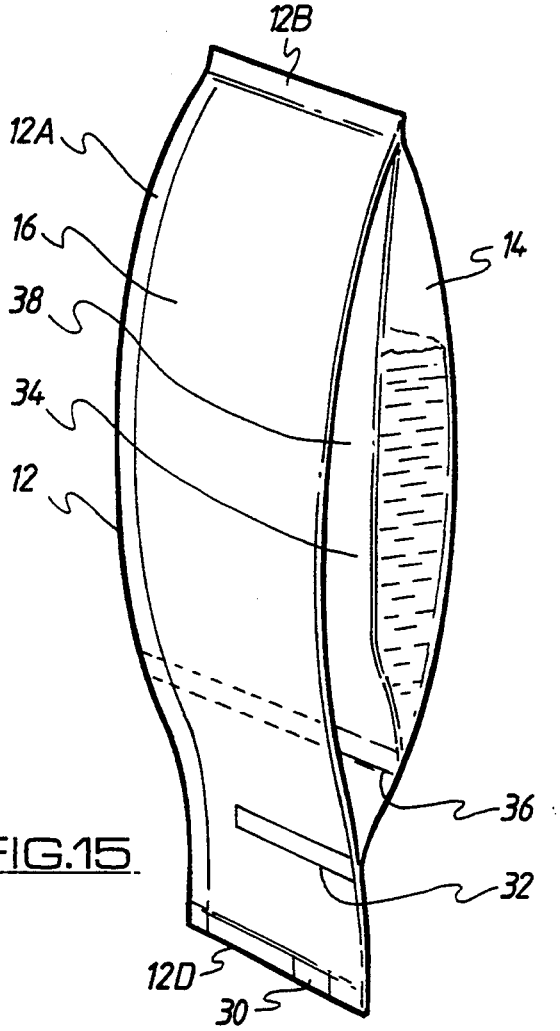
FIG. 15 is a cut-away perspective view of a sachet according to another embodiment of the invention.
Figure 16:
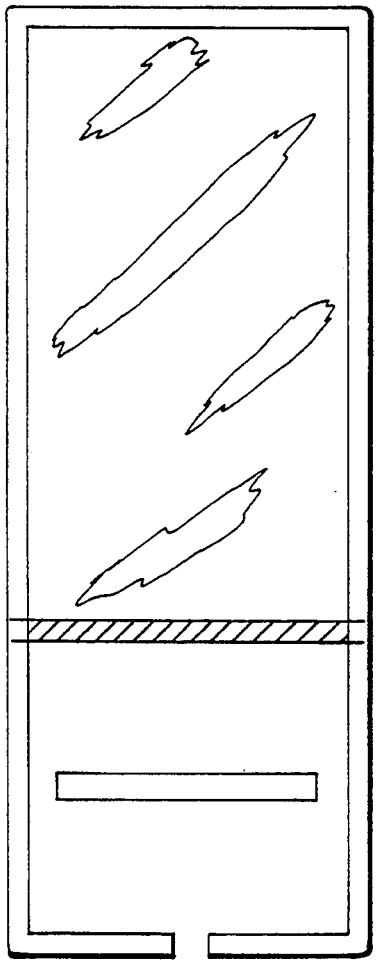
FIG. 16 shows a side view of the sachet shown in FIG. 15.

FIGS. 15 and 16 show a further alternative embodiment of the sachet according to FIGS. 8–14. In the FIGS. 15 and 16 construction, the sealed compartment is formed by a single inner sheet or membrane 34 which is sealed to one, 14, of the outer panels at an edge region 36 and also to the sealed edge 12B. The expansion chamber 38 is formed between the inner layer 34 and the other outer panel 16 as shown. The baffle seal 32 again is provided as is the aperture 30. The inner layer 34 may be of a weaker material than the outer panels 14 and 16 so that it will predictably rupture when the sachet is pressurized for dispensing of the contents as obviously it would be undesirable if the outer panel were to rupture rather than the inner layer 34. Alternatively, the seal 36 may be made so as to be of a weak nature whereby the seal will give first causing the contents to charge into the expansion chamber. Dispensing will take place as described herein before.

Figure 17:
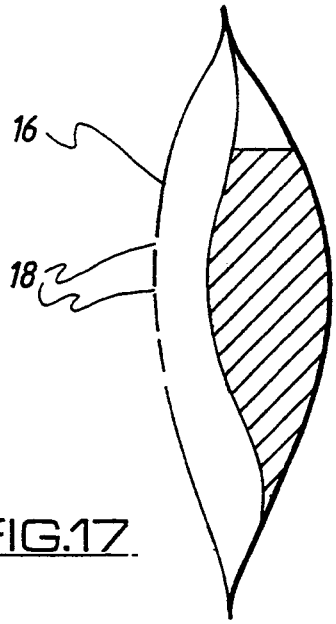
FIG. 17 is a sectional end view of a sachet similar to that shown in FIG. 15 but according to a further embodiment.
Figure 18:
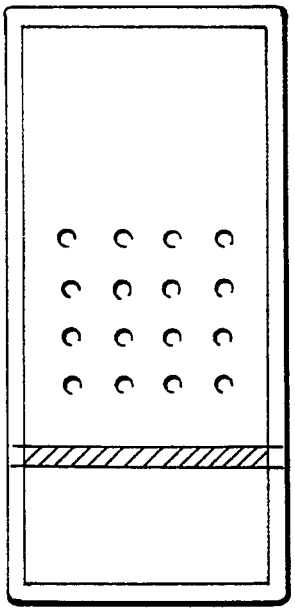
FIG. 18 is a side view of the sachet shown in FIG. 17.

In the embodiment of FIGS. 17 and 18, instead of the baffle seal 32, the panel 16 is provided with the dispensing apertures 18 approximately centrally thereof, somewhat similar to the embodiment of FIGS. 1–7.

Figure 19:
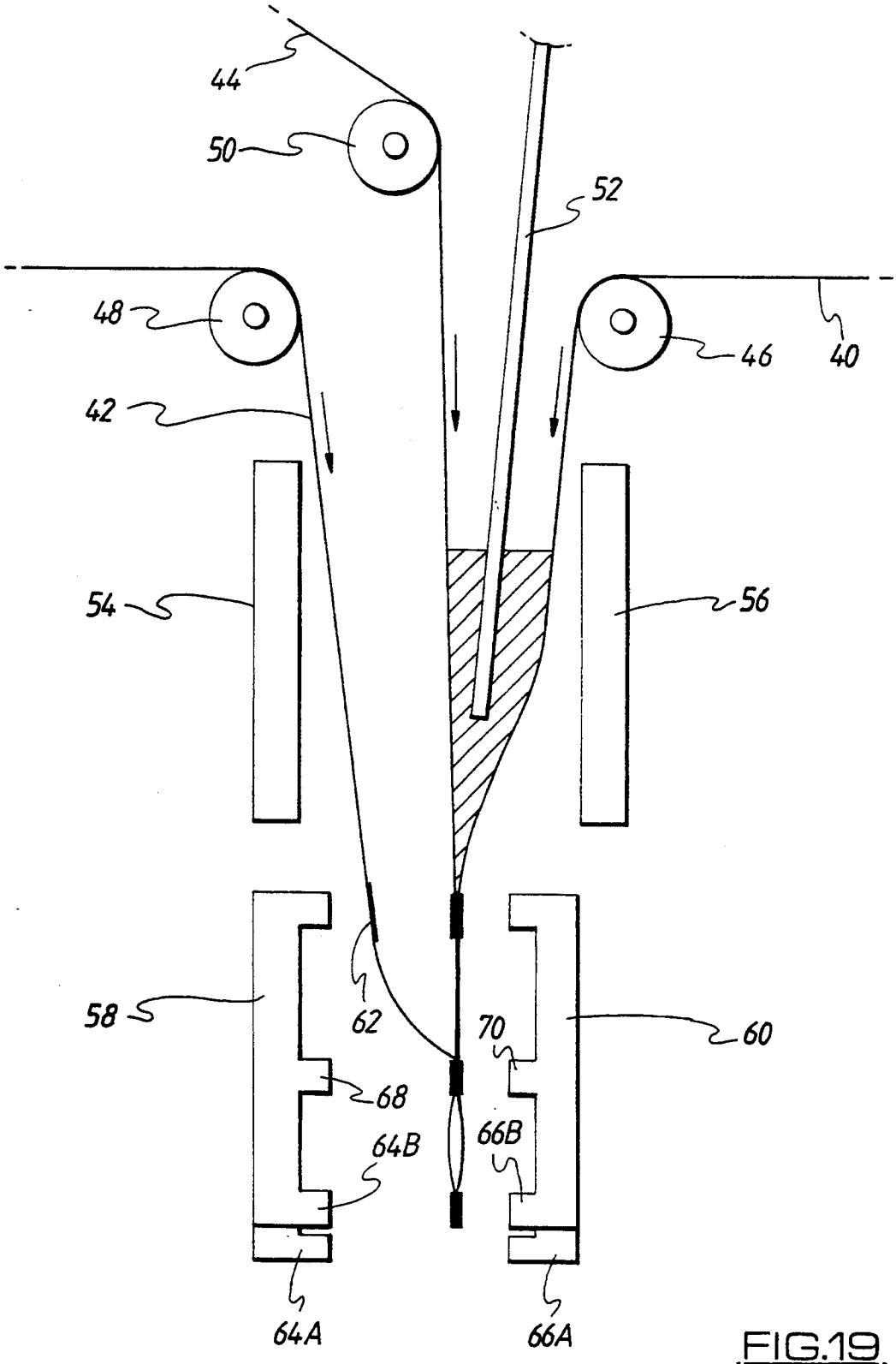
FIG. 19 is a sectional view of a method and apparatus for producing sachets as shown in FIGS. 15 and 16.

For the manufacture of the sachets shown in FIGS. 15–18, three webs 40, 42, and 44 are supplied from stock rolls and are fed over guide rollers 46, 48 and 50 so as to travel in a downwards direction and in face to face arrangement as shown in FIG. 19. A contents filling tube 52 serves to charge portions of liquid or fluent paste material between the web 40 and the web 44 after these webs have been sealed edge to edge by means of the side seaming jaws 54, 56 which form seal regions 12A and 12C and a previously formed seal 36 which extends transverse to the direction of feed of the webs. The webs 40, 42 and 44 are then advanced downwardly to bottom sealing Jaws 58 and 60 which effect the transverse sealing joining together of the three webs and thereby forming the sachets which can then be cut from the webs. The inner side of the web 42, which in fact will form the outer panels 16 is printed with a paint for example in the region 62 to stop it from sealing to the inner layer 34 along the seal 36. The seal forming projections 64A, 64B and 66A, 66B form the edge regions 12D and 12B of adjacent sachets, projections 64B, 66B having an interruption to form aperture 30. Portions 68 and 70 form the baffle seal 32 and they are appropriately dimensioned so as to have their ends displaced from the seal edge 12 to enable the contents to flow round the seal as indicated in FIG. 14.

In order to form the sealed sachets shown in FIGS. 15 and 16 with the apparatus and method shown in FIG. 19 therefore, after the side seal regions 12A, 12C have been formed and before liquid is charged into the space between the webs 40 and 44, the bottom jaws 58 and 60 are brought together to effect the appropriate heat sealing. These jaws form seals 36, 32 and the edge seal regions 12B of the next sachet and the seal 12D of the previously filled sachet. The portion of contents is then injected between the webs 40 and 44 and then the assembly of webs advances after opening of the sealing jaws 58, 60 until the sealed compartment containing the contents is only Just below the lower end of jaws 58 and 60. The process is repeated and the bottom Jaws serve to seal the remaining portion of the sealed edge 12. The webs are severed between projections 64A, 66A and 64B, 66B.

Figure 20A:
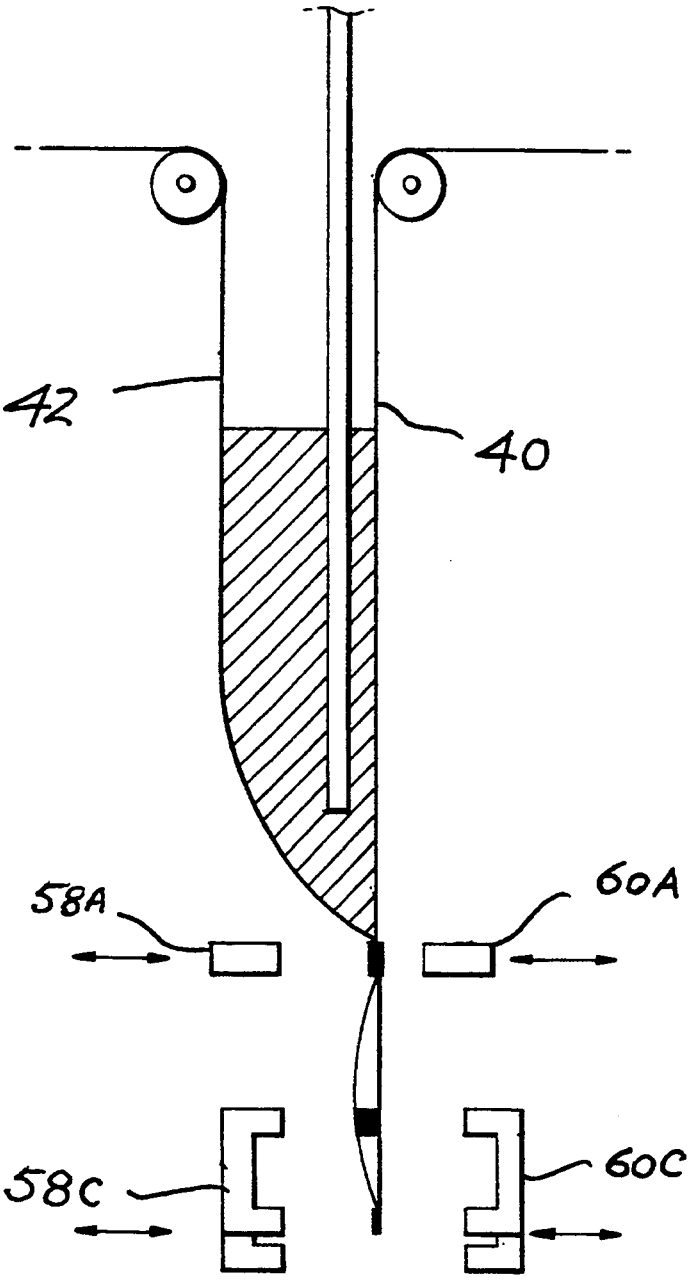
FIGS. 20A and 20B are views similar to FIGS. 19 and 20, but show methods for producing the sachets of FIGS. 7C and 7D and 13E and 13F.
Figure 20B:
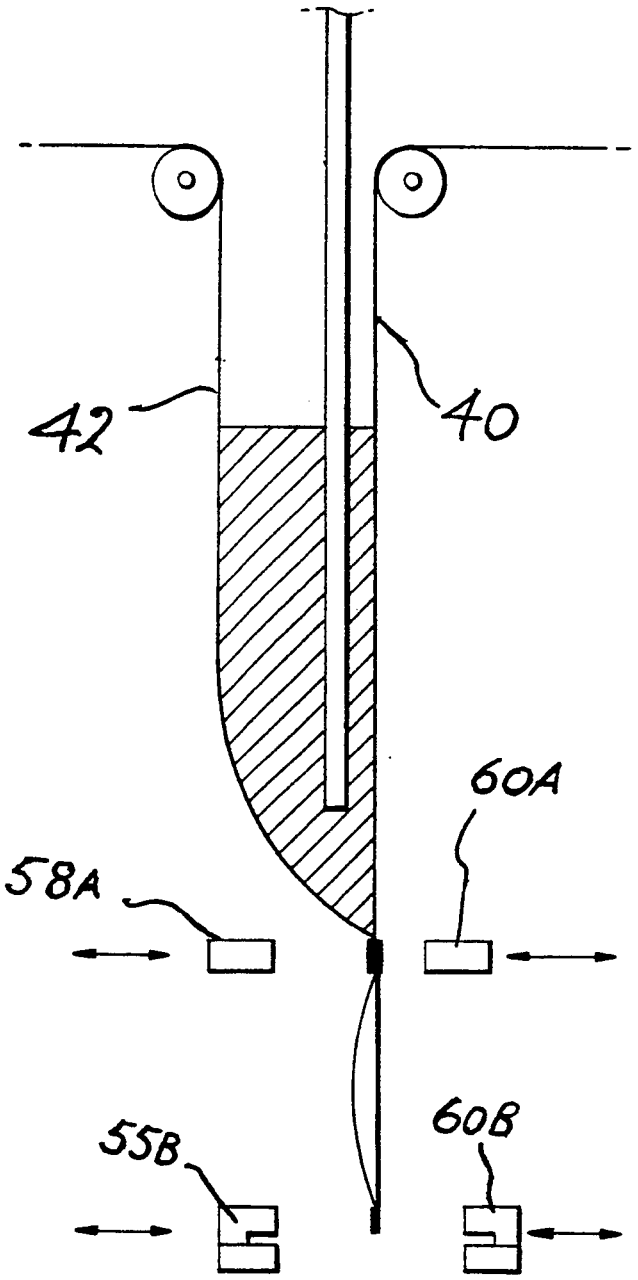

Sachets as illustrated in FIGS. 7C and 7D are manufactured by the method shown in FIG. 20B. The webs 42 and 40 are fed as indicated in FIG. 19, to a first (weak seal) head comprising low temperature heat sealing jaws 58A, 60A which effect the weak seal 15 shown in FIGS. 7C, 7D by pinching the webs 40, 42 together. The filling liquid is introduced above the weak seal by means of the filling pipe 52. A permanent seal 12B is formed by the (permanent seal) jaws 55B, 60B which operate simultaneously with the jaws 58A, 60A, as indicated by the arrows. The holes 18 in the expansion chamber formed between the weak and permanent seals are also shown.

The method for producing the sachets of FIGS. 13E and 13F is shown in FIG. 20A. The only difference compared to the FIG. 20B method is that the jaws 55B and 60B are replaced by jaws 58C, 60C which are shaped so as to produce the seals 12B and 32 (Barrier Seal).

Weak sealing can be achieved by using suitable plastic films e.g. polythene, polyurethane which can be sealed together weakly by using low temperature sealing jaws and can be sealed permanently using high temperature sealing jaws.

FIGS. 22A and 22B show an embodiment of the invention wherein a further feature is embodied. The sachet is essentially as illustrated in FIGS. 8 to 14, except that the seal at the end 12B is extended and extending into the seal is a pocket 23 which does not extend completely through the sealed end 12B. The outer envelope therefore is completely sealed.

If the sealed sachet is cut or torn for example along line 25, across the pocket 23, the pocket becomes outlet 30. Thereafter, the sachet is used exactly as described in relation to FIGS. 8 to 14. The line 25 may be a line of weakening so that tearing open the sachet is predictable. This feature can be used where possible, in any embodiment of the invention described herein, and it is particulary applicable where a sachet which must be completely sealed until it is to be used or required.

Generally, any feature of any sachet described herein is to be considered where possible as being useable in any other sachet.

In the arrangement of FIG. 20, instead of providing a printed pattern using a paint which prevents heat sealing as in FIG. 19, a plate or strip of PTFE tape of the like indicated by reference 70 is used to prevent the heat sealing at the particular locations as required. FIG. 21 shows that a plurality of sachets are formed in the web in side by side array.

In all embodiments of the sachets of the invention the sachets are entirely of flexible sheet material and are used in that the inner compartment containing the fluent medium is popped to expel the contents into the expansion chamber wherein the said contents are slowed down and do not inconveniently discharge from the outlet and the user can pour the said contents directly from the sachet at his leisure.

The invention also provides effective and efficient methods for producing disposable sachets which in themselves comprise novel and advantageous products.

We claim:

1. A sachet for dispensing a portion of a fluent medium characterized in that the sachet is composed entirely of three flexible sheet material sections of the same size sealed together peripherally in face-to-face arrangement, a sealed compartment defined between one of the outer sections and the middle section containing said fluent medium, and an expansion chamber, said sealed compartment being designed to be popped open by hand pressure to cause the fluent medium to be ejected from the compartment into the expansion chamber which slows down the ejecting medium, said expansion chamber having outlet means whereby the fluent medium can at the user's leisure be poured directly from the sachet.

2. A sachet according to claim 1, characterized in that said outlet means is provided in the expansion chamber by providing a gap in the peripheral seal of the sachet.

3. A sachet according to claim 1, which includes a baffle located between the sealed compartment and said outlet means.

4. A sachet according to claim 1, wherein the sachet is of rectangular configuration and the sealed compartment is at one end thereof.

5. A method for the manufacture of sachets that have the structure set forth in claim 1, comprising feeding in the same direction three webs of flexible sheet material in a face-to-face arrangement, sealing the outer webs and the inner web together in the direction of feeding of the webs and transverse to said feeding direction to partially define the sealed compartments and the expansion chambers, inserting the fluent medium in said partially defined compartments, sealing the webs transverse to the feeding direction to complete the sealing of the expansion chambers and compartments and also including the step of creating a break in the peripheral seals of the outer webs to form said outlet means.

* * * * *